US011595751B2

(12) United States Patent
Pinkerton et al.

(10) Patent No.: US 11,595,751 B2
(45) Date of Patent: Feb. 28, 2023

(54) LOUDSPEAKER WITH ARRAY OF ELECTROSTATIC CARD STACK DRIVERS

(71) Applicant: CLEAN ENERGY LABS, LLC, Austin, TX (US)

(72) Inventors: Joseph F. Pinkerton, Austin, TX (US); David A. Badger, Lago Vista, TX (US); William Martin Lackowski, Austin, TX (US); James A. Andrews, Austin, TX (US)

(73) Assignee: Clean Energy Labs, LLC, Austin, TX (US)

( * ) Notice: Subject to any disclaimer, the term of this patent is extended or adjusted under 35 U.S.C. 154(b) by 8 days.

(21) Appl. No.: 17/052,481

(22) PCT Filed: May 2, 2019

(86) PCT No.: PCT/US2019/030438
§ 371 (c)(1),
(2) Date: Nov. 2, 2020

(87) PCT Pub. No.: WO2019/213422
PCT Pub. Date: Nov. 7, 2019

(65) Prior Publication Data

US 2021/0250680 A1 Aug. 12, 2021

Related U.S. Application Data

(60) Provisional application No. 62/805,210, filed on Feb. 13, 2019, provisional application No. 62/666,002, filed on May 2, 2018.

(51) Int. Cl.
*H04R 3/00* (2006.01)
*H04R 1/26* (2006.01)
(Continued)

(52) U.S. Cl.
CPC ..... *H04R 1/26* (2013.01); *H04R 1/222* (2013.01); *H04R 1/403* (2013.01); *H04R 19/02* (2013.01); *H04R 1/2838* (2013.01)

(58) Field of Classification Search
CPC ..... H04R 5/00; H04R 5/02; H04R 1/26
(Continued)

(56) References Cited

U.S. PATENT DOCUMENTS 4,051,919 A * 10/1977 Buettner ..... H04R 1/20 181/144
9,143,868 B2 9/2015 Pinkerton et al.
(Continued)

FOREIGN PATENT DOCUMENTS

WO 2019213422 A1 11/2019

OTHER PUBLICATIONS

ASWY That's Life: "The World's First 720° SPACO Levitating Home Theater", Nov. 2, 2016 (Nov. 2, 2016), pp. 1-2.
(Continued)

*Primary Examiner* — Katherine A Faley
(74) *Attorney, Agent, or Firm* — Dickinson Wright PLLC; Ross Spencer Garsson

(57) ABSTRACT

Dipole audio speakers, and more particularly, voice controlled dipole audio speakers having at least one microphone located substantially along the null sound plane of the dipole audio speaker. An improved loudspeaker system that produces an improved audio quality for stereophonic sound. The improved loudspeaker utilizes conventional electrodynamic drivers in a sealed chamber that produce sound primarily in the 20-300 Hz band coupled with electrostatic card stack drivers placed outside the sealed chamber that cover the remaining 98% of the audio frequency spectrum (300 Hz to 20 kHz). The improved loudspeaker system can
(Continued)

also include multiple card stack drivers that are placed at angles with respect to each other to maximize audio fidelity.

15 Claims, 21 Drawing Sheets

(51) Int. Cl.
*H04R 1/22* (2006.01)
*H04R 1/40* (2006.01)
*H04R 19/02* (2006.01)
*H04R 1/28* (2006.01)

(58) Field of Classification Search
USPC ..... 381/300, 303–305, 307
See application file for complete search history.

(56) References Cited

U.S. PATENT DOCUMENTS

| | | | | |
|---|---|---|---|---|
| 9,167,353 | B2 | 10/2015 | Pinkerton et al. | |
| 9,264,795 | B2 | 2/2016 | Pinkerton et al. | |
| 9,826,313 | B2 | 11/2017 | Pinkerton et al. | |
| 9,924,275 | B2 | 3/2018 | Pinkerton et al. | |
| 10,250,997 | B2 | 4/2019 | Pinkerton et al. | |
| D883,952 | S | 5/2020 | Lucas et al. | |
| 2002/0146139 | A1* | 10/2002 | Oplinger | H04R 5/02 381/300 |
| 2007/0242844 | A1 | 10/2007 | Harman | |
| 2007/0291383 | A1 | 12/2007 | Watson et al. | |
| 2010/0177921 | A1* | 7/2010 | Bos | H04R 1/26 381/351 |
| 2016/0345083 | A1* | 11/2016 | Pinkerton | H04R 19/02 |
| 2016/0353198 | A1* | 12/2016 | Sahyoun | H04R 1/2826 |

OTHER PUBLICATIONS

Authorized Officer Paula Ipinazar ; International Preliminary Report on Patentability for PCT/US2019/030438 dated Oct. 23, 2020, 56 pages.

International Searching Authority, International Search Report and Written Opinion for PCT/US2019/030438 dated Jul. 19, 2019, 22 pages.

Patent Cooperation Treaty, Written Opinion of the International Preliminary Examining Authority for PCT/US2019/030438 dated May 25, 2020, pp. 15.

* cited by examiner

LOUDSPEAKER WITH ARRAY OF ELECTROSTATIC CARD STACK DRIVERS

CROSS-REFERENCE TO RELATED PATENT APPLICATIONS

This application is a 35 U.S.C § 371 national application of PCT Application No. PCT/US19/30438, filed on May 2, 2019, entitled "Loudspeaker System And Method Of Use Thereof", which claims priority to (a) U.S. Provisional Patent Application Ser. No. 62/666,002, filed on May 2, 2018, to Joseph F. Pinkerton et al., and entitled "Audio Speakers," and (b) U.S. Provisional Patent Application Ser. No. 62/805,210, filed on Feb. 13, 2019, to Joseph F. Pinkerton et al., and entitled "Loudspeaker System And Method Of Use Thereof."

This application also relates to: U.S. Pat. No. 9,826,313, issued Nov. 21, 2017, to Joseph F. Pinkerton et al., and entitled "Compact Electroacoustic Transducer And Loudspeaker System And Method Of Use Thereof," ("the Pinkerton '313 Patent,") which issued from U.S. patent application Ser. No. 14/717,715, filed May 20, 2015; U.S. patent application Ser. No. 14/309,615, filed on Jun. 19, 2014, to Joseph F. Pinkerton et al., and entitled "Electrically Conductive Membrane Pump/Transducer And Methods To Make And Use Same," (the "Pinkerton '615 Application"), which is a continuation-in-part to U.S. patent application Ser. No. 14/161,550, filed Jan. 22, 2014; U.S. patent application Ser. No. 15/017,452, to Joseph F. Pinkerton et al., entitled "Loudspeaker Having Electrically Conductive Membrane Transducers," filed Feb. 5, 2016, (the "Pinkerton '452 Application"); U.S. patent application Ser. No. 15/647,073, filed Jul. 11, 2017, to Joseph F. Pinkerton et al., and entitled "Electrostatic Membrane Pump/Transducer System And Methods To Make And Use Same," ("the Pinkerton '073 Application"); U.S. patent application Ser. No. 15/333,488, filed Oct. 25, 2016, to Joseph F. Pinkerton et al., and entitled "Compact Electroacoustic Transducer And Loudspeaker System And Method Of Use Thereof," ("the Pinkerton '488 Application"); U.S. patent application Ser. No. 29/617,037, filed Sep. 11, 2017, to David Lucas et al., and entitled "Audio Speaker," ("the Lucas '037 Application"); U.S. Patent Application Ser. No. 62/697,055, filed on Jul. 12, 2018, and entitled "Compact Electroacoustic Transducer and Loudspeaker System and Method Of Use Thereof" (the "Pinkerton '055 Application"); and U.S. Patent Application Ser. No. 62/673,620, entitled "Compact Electroacoustic Transducer And Loudspeaker System And Method Of Use Thereof," to David Badger et al., filed May 18, 2018 (the "Badger '620 Application").

All of the above-identified patent applications are commonly assigned to the Assignee of the present invention and are hereby incorporated herein by reference in their entirety for all purposes.

TECHNICAL FIELD

The present invention relates to loudspeaker systems, and more particularly, voice controlled audio speakers having one or more dipole transducers and also, more particularly, to stereophonic loudspeakers systems having an array of electrostatic transducers. The electrically conductive transducers generate the desired sound by the use of pressurized airflow.

BACKGROUND

Stereophonic sound or, more commonly, stereo, is a method of sound reproduction that creates an illusion of multi-directional audible perspective. This is usually achieved by using two or more independent audio channels through a configuration of two or more loudspeakers (or stereo headphones) in such a way as to create the impression of sound heard from various directions, as in natural hearing. Thus the term "stereophonic" applies to so-called "quadraphonic" and "surround-sound" systems as well as the more common two-channel, two-speaker systems. It is often contrasted with monophonic, or "mono" sound, where audio is heard as coming from one position, often ahead in the sound field (analogous to a visual field). Stereo sound is common in entertainment systems such as broadcast radio, TV, recorded music, and cinema.

There are various techniques for recording the independent audio channels for stereophonic sound, including (a) the A-B technique (time-of-arrival stereophony), (b) the X-Y technique: intensity stereophony, M/S technique: mid-side stereophony, and near-coincident technique (mixed stereophony), and pseudo-stereo.

Stereophonic sound attempts to create an illusion of location for various sound sources (voices, instruments, etc.) within the original recording by utilizing the independent audio channel recordings. The recording engineer's goal is usually to create a stereo "image" with localization information. When a stereophonic recording is heard through loudspeaker systems (rather than headphones), each ear, of course, hears sound from both speakers. The audio engineer may, and often does, use more than two microphones (sometimes many more) and may mix them down to two (or more) tracks in ways that exaggerate the separation of the instruments, to compensate for the mixture that occurs when listening via speakers.

Descriptions of stereophonic sound tend to stress the ability to localize the position of each instrument in space, but this would only be true in a carefully engineered and installed system, where speaker placement and room acoustics are taken into account. In reality, many playback systems, such as all-in-one loudspeaker system units and the like, are incapable of recreating a realistic stereo image.

Originally, in the late 1950s and 1960s, stereophonic sound was marketed as seeming "richer" or "fuller-sounding" than monophonic sound, but these sorts of claims were and are highly subjective, and again, dependent on the equipment used to reproduce the sound. In fact, poorly recorded or reproduced stereophonic sound can sound far worse than well done monophonic sound. When playing back stereo recordings, the best results are obtained by using two identical speakers, in front of and equidistant from the listener, with the listener located on a center line between the two speakers. In effect, an equilateral triangle is formed, with the angle between the two speakers around 60 degrees as seen from the listener's point of view.

Accordingly, there continues to be a need for a speaker system for improved listening of stereophonic sound.

In recent years, the audio speaker market has incorporated microphones into the audio speakers to capture voice-activated instructions from the users (i.e., voice activated/voice controlled speakers). However, because speakers by their very nature produce audible sounds when in use, this causes interference and other problems with the reception of sound waves by the microphones. For example, Amazon's Echo struggles to perceive human voices when its music is turned all the way up. Hence, there are problems with receiving voice activation instructions in a voice-controlled speaker, particularly when the sound emitting from the speaker is at loud decibels (dB), such as above 90 dB. This then requires the user to speak at louder levels (so as to be "heard" by the microphone), move closer to the speaker, and/or use manual controls to operate the device.

Accordingly, the positioning of the microphones is one of the most challenging tasks with voice-controlled speakers.

Thus, there is a need for an improved microphone system in voice-controlled speakers, especially systems that provide for voice activation even when the sound being emitted from the speaker is above 90 dB near the speaker.

SUMMARY OF THE INVENTION

The present invention relates to an improved voice activated speaker in which the speaker is a dipole speaker with the microphones situated substantially along a null sound plane that is produced by the dipole speaker.

The present invention further relates to an improved loudspeaker system that produces an improved audio quality for stereophonic sound. The improved loudspeaker utilizes the loudspeaker devices set forth in the Pinkerton '055 Application (including the devices set forth in the Badger '620 Application) modified such that the wider card driver (21 mm) is replaced with conventional electro-dynamic drivers (along with optional passive radiators) inside a sealed chamber that cover the audio frequency range of 20 Hz to approximately 300 Hz. The narrower (12 mm) electrostatic card stacks cover the remaining 98% of the audio frequency spectrum (300 Hz to 20 kHz). Both the stacks and cones can operate in the 200-500 Hz range. The device of the present invention can also include multiple card stacks that are placed outside of the sealed chamber and are angled with respect to each other to produce high fidelity sound.

In general, in one aspect, the invention features a loudspeaker having a middle section, a first end section located on a first side of the middle section, and a second end section located on the opposing side of the middle section. The loudspeaker includes one or more electro-dynamic drivers in a sealed chamber. The sealed chamber is in the middle section of the loudspeaker. The loudspeaker further includes a first electrostatic card stack driver and a second electrostatic card stack driver that are arranged in the loudspeaker at the first end section having an arranged angle between them of at least 30 degrees. The loudspeaker further includes a third electrostatic card stack driver and a fourth electrostatic card stack driver that are arranged in the loudspeaker at the second end section having an arranged angle between them of at least 30 degrees.

Implementations of the invention can include one or more of the following features:

The one or more electro-dynamic drivers can be operable to produce sound having an audio frequency in the range of 20 Hz to 300 Hz. Each of the first electrostatic card stack driver, the second electrostatic card stack driver, the third electrostatic card stack driver, and the fourth electrostatic card stack driver can be operable to produce sound having an audio frequency in the range of 300 Hz to 20 kHz.

Each of the one or more electro-dynamic drivers and the first electrostatic card stack driver, the second electrostatic card stack driver, the third electrostatic card stack driver, and the fourth electrostatic card stack driver can be operable to produce sound having an audio frequency in the range of 200 Hz to 500 Hz.

Each of the first electrostatic card stack driver, the second electrostatic card stack driver, the third electrostatic card stack driver, and the fourth electrostatic card stack driver can include card stacks having a width of around 12 mm.

The first electrostatic card stack driver and the second electrostatic card stack driver can have an arranged angle between them that is in the range of 45 degrees and 120 degrees. The third electrostatic card stack driver and the fourth electrostatic card stack driver can have an arranged angle between them that is in the range of 45 degrees and 120 degrees.

The first electrostatic card stack driver and the second electrostatic card stack driver can have an arranged angle between them that is in the range of 60 degrees and 90 degrees. The third electrostatic card stack driver and the fourth electrostatic card stack driver can have an arranged angle between them that is in the range of 60 degrees and 90 degrees.

The loudspeaker can have a null sound plane for the first electrostatic card stack driver, the second electrostatic card stack driver, the third electrostatic card stack driver, and the fourth electrostatic card stack driver running from the first end section and the second end section.

The loudspeaker can further include at least one microphone located substantially along the null sound plane.

The loudspeaker can further include a controller for controlling each of the one or more electro-dynamic drivers and the first electrostatic card stack driver, the second electrostatic card stack driver, the third electrostatic card stack driver, and the fourth electrostatic card stack driver.

At least one of the one or more electro-dynamic drivers can have a passive radiator.

In general, in another aspect, the invention features a method that includes the step of selecting a loudspeaker. The loudspeaker includes one or more electro-dynamic drivers in a sealed chamber. The loudspeaker can further include a plurality of electrostatic card stack drivers. The method further includes the step of utilizing the one or more electro-dynamic drivers to produce sound having an audio frequency in the range of 20 Hz to 300 Hz. The method further includes the step of utilizing the plurality of the electrostatic card stack drivers to produce sound having an audio frequency in the range of 300 Hz to 20 kHz.

Implementations of the invention can include one or more of the following features:

The loudspeaker can have a middle section, a first end section located on a first side of the middle section, and a second end section located on the opposing side of the middle section. The sealed chamber can be in the middle section of the speaker. The plurality of electrostatic card stack driver can include a first electrostatic card stack driver, a second electrostatic card stack driver, a third electrostatic card stack driver, and a fourth electrostatic card stack driver. The first electrostatic card stack driver and the second electrostatic card stack driver can be arranged in the speaker at the first end section having an arranged angle between them of at least 30 degrees. The third electrostatic card stack driver and the fourth electrostatic card stack driver can be arranged in the loudspeaker at the second end section having an arranged angle between them of at least 30 degrees.

The method can further include the step of utilizing each of the one or more electro-dynamic drivers and the first electrostatic card stack driver, the second electrostatic card stack driver, the third electrostatic card stack driver, and the fourth electrostatic card stack driver to produce sound having an audio frequency in the range of 200 Hz to 500 Hz.

Each of the first electrostatic card stack driver, the second electrostatic card stack driver, the third electrostatic card stack driver, and the fourth electrostatic card stack driver can include card stacks having a width of around 12 mm.

The first electrostatic card stack driver and the second electrostatic card stack driver can have an arranged angle between them that is in the range of 45 degrees and 120 degrees. The third electrostatic card stack driver and the fourth electrostatic card stack driver can have an arranged angle between them that is in the range of 45 degrees and 120 degrees.

The first electrostatic card stack driver and the second electrostatic card stack driver can have an arranged angle between them that is in the range of 60 degrees and 90 degrees. The third electrostatic card stack driver and the fourth electrostatic card stack driver can have an arranged angle between them that is in the range of 60 degrees and 90 degrees.

The loudspeaker can have a null sound plane for the first electrostatic card stack driver, the second electrostatic card stack driver, the third electrostatic card stack driver, and the fourth electrostatic card stack driver running from the first end section and the second end section.

The method can further include the step of utilizing at least one microphone that is located substantially along the null sound plane.

The method can further include the step of utilizing a controller to control each of the one or more electro-dynamic drivers and the first electrostatic card stack driver, the second electrostatic card stack driver, the third electrostatic card stack driver, and the fourth electrostatic card stack driver.

At least one of the one or more electro-dynamic drivers can have a passive radiator.

In general, in another aspect, the invention features a loudspeaker that includes one or more electro-dynamic drivers in a sealed chamber that are operable to produce sound primarily in the range of 20 and 300 Hz. The loudspeaker further includes a plurality of electrostatic card stack drivers placed outside the sealed chamber that are operable to produce sound primarily in the range of 300 Hz and 20 kHz.

Implementations of the invention can include one or more of the following features:

Each of the one or more electro-dynamic drivers and the plurality of the electrostatic card stack drivers can be operable to produce sound having an audio frequency in the range of 200 Hz to 500 Hz.

In general, in another aspect, the invention features a dipole speaker that includes at least one microphone located substantially along a null sound plane of the dipole speaker Implementations of the invention can include one or more of the following features:

The dipole speaker can include a plurality of electrostatic transducers.

The dipole speaker can include at least one electro-dynamic transducer.

In general, in another aspect, the invention features a method that includes measuring sound from a dipole speaker to determine a null sound plane of the dipole speaker. The method further includes positioning at least one microphone on the dipole speaker along the null sound plane.

Implementations of the invention can include one or more of the following features:

The dipole speaker can include a plurality of electrostatic transducers.

The dipole speaker can include at least one electro-dynamic transducer.

DETAILED DESCRIPTION

Dipole Speakers

The speakers disclosed and taught in the Pinkerton '073 Application, the Pinkerton '488 Application, and the Lucas '037 Application are dipole speakers. Examples of such dipole speakers disclosed and taught therein are shown in FIGS. 1 and 2A-2E. Dipole speakers have speaker drivers that create airflow on opposite sides of the speaker case, thus creating bidirectional sound, and the sound from the opposite sides are opposite in phase from one another. Dipole speakers use electrostatic, electro-dynamic and other types of electroacoustic transducers.

Figure 1:
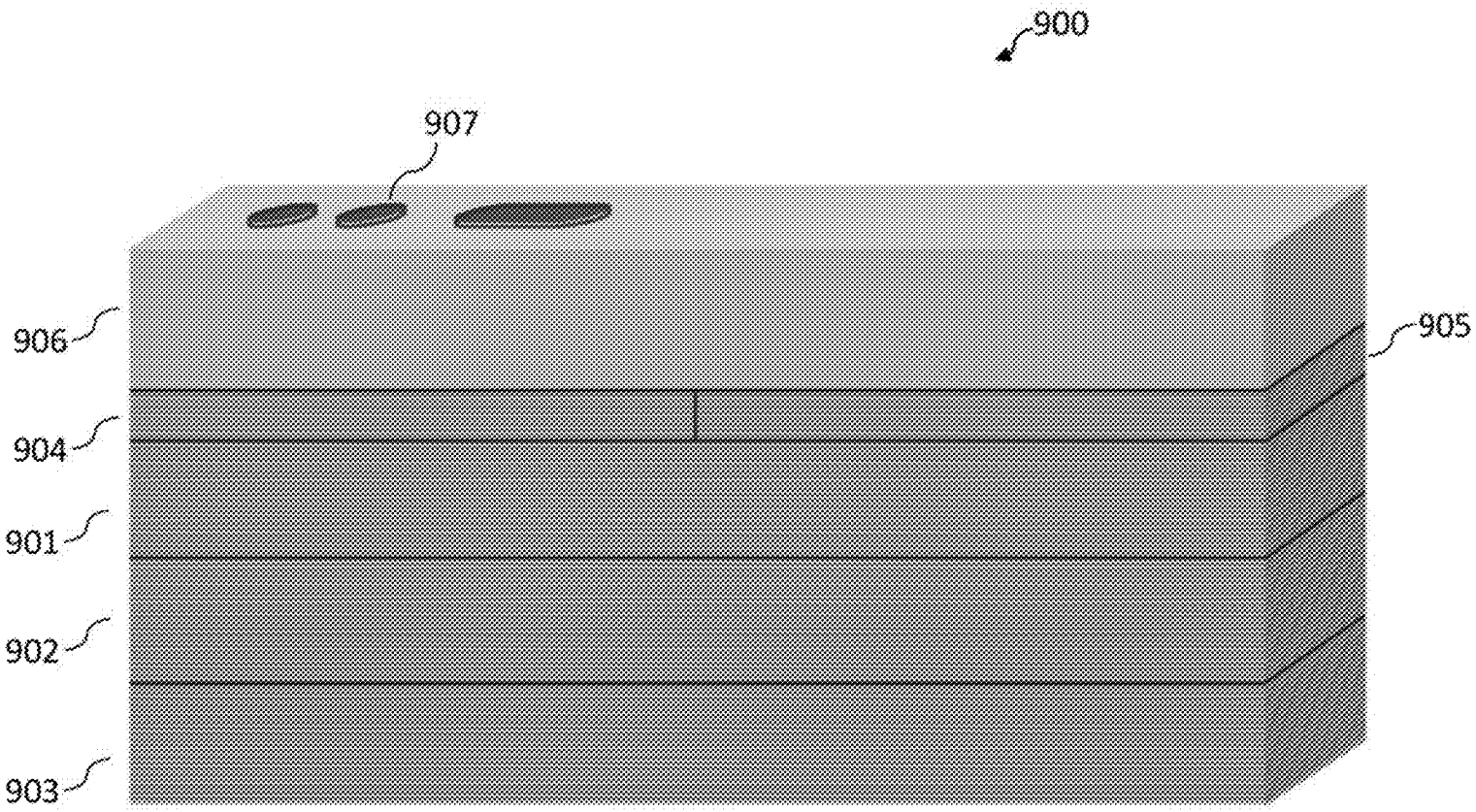
FIG. 1 depicts an illustration that is FIG. 9A of the Pinkerton '073 Application, which illustrates a loudspeaker with stacked arrays of electrostatic venturi membrane-based pump/transducer (EVMP) cards.

FIG. 1 (which is FIG. 9A of the Pinkerton '073 Application) shows a speaker 900 that utilizes stacked arrays of electrostatic Venturi membrane pump ("EVMP") cards 901-903. Each of EVMP card stacked array 901-903 has two face areas, on one side of speaker 900 (such as face area 909 for ESVP card stacked array 903) and the other side of the speaker 900 (which is hidden in the view of FIG. 1). Air enters and exits the EVMP cards through each of the EVMP card stacked array face areas. The speaker 900 also utilizes two (one for each of the two stereo channels) synchronous electrostatic audio actuator card stacks 904-905. I.e., conventional card stacks 904-905 are electrostatic tweeter cards. The speaker 900 also includes electronics and battery 906 with control buttons 907.

Null Sound Plane

Figure 2B:
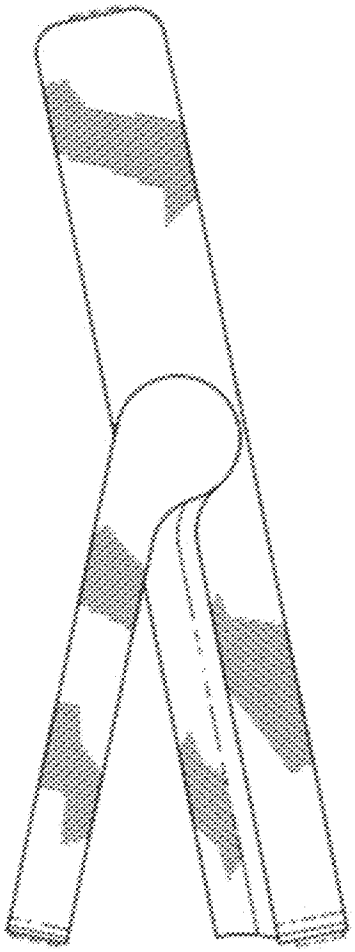
FIG. 2B depicts an illustration that is FIG. 3 of the Lucas '037 Application, which is a left side view of the audio speaker of FIG. 2A (open position).
Figure 2A:
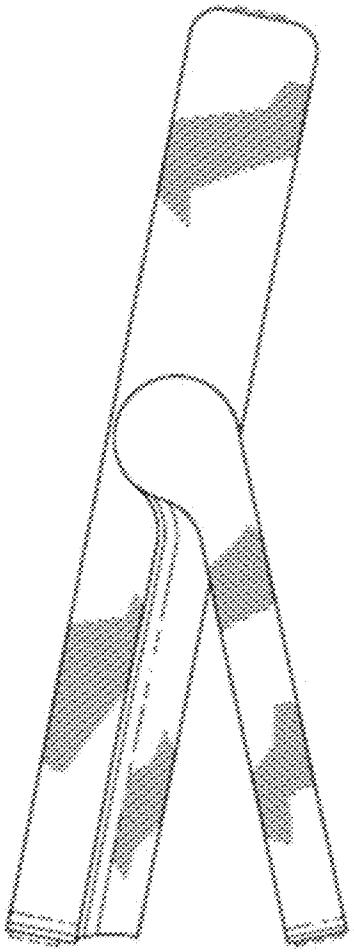
FIG. 2A depicts an illustration that is FIG. 2 of the Lucas '037 Application, which is a right side view of an audio speaker (open position).
Figure 2C:
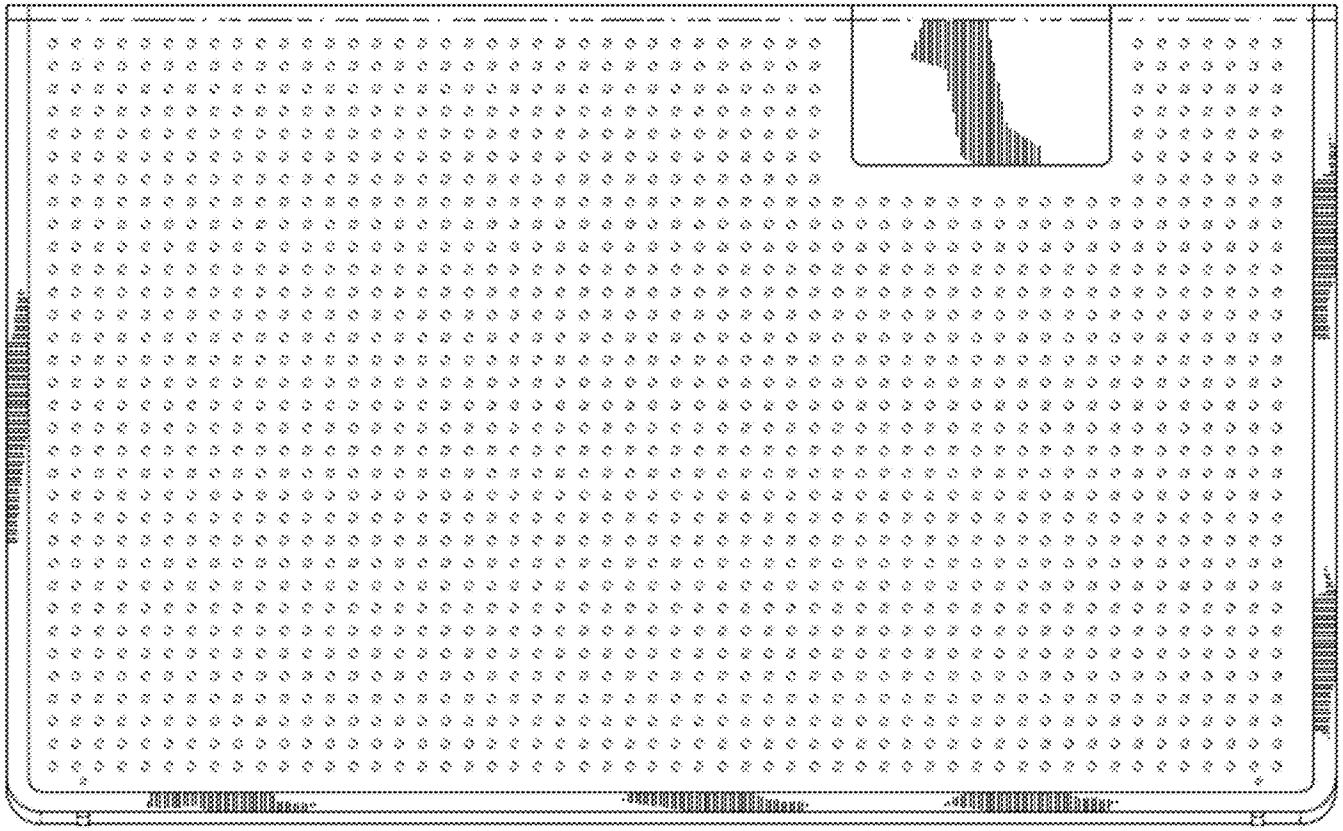
FIG. 2C depicts an illustration that is FIG. 5 of the Lucas '037 Application, which is a front view of the audio speaker of FIG. 2A (closed position).
Figure 2D:
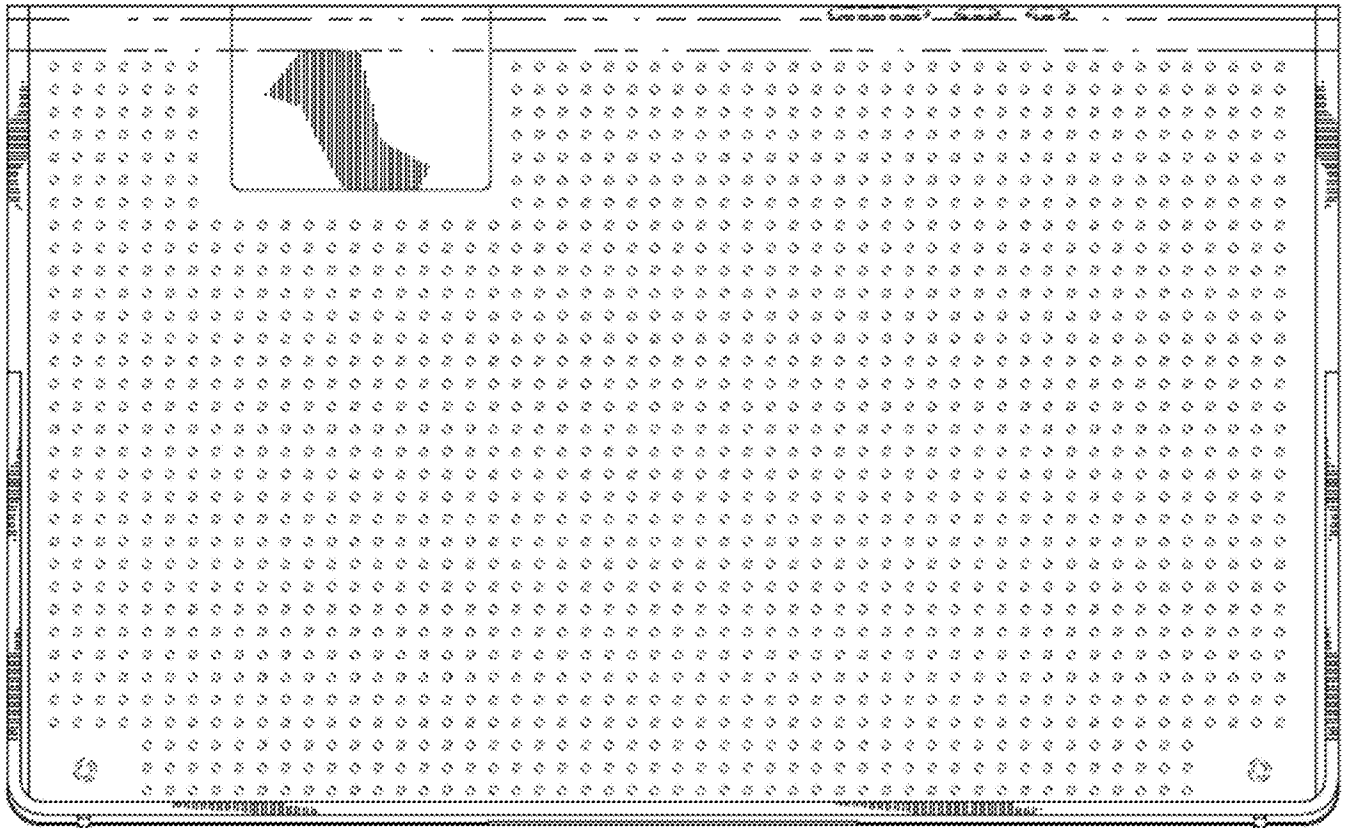
FIG. 2D depicts an illustration that is FIG. 6 of the Lucas '037 Application, which is a back view of the audio speaker of FIG. 2A (closed position).
Figure 2E:
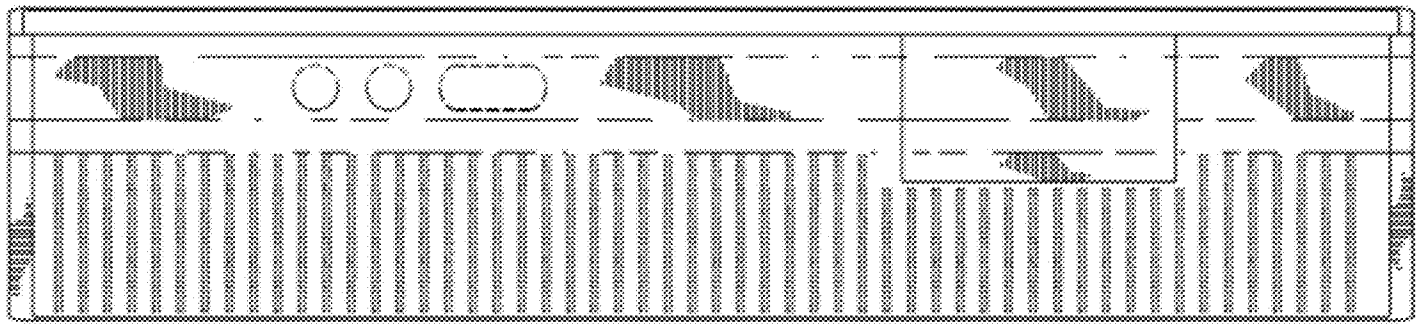
FIG. 2E depicts an illustration that is FIG. 7 of the Lucas '037 Application, which is a top view of the audio speaker of FIG. 2A (closed position).

FIGS. 2A-2E (which are FIGS. 2-3 and 5-7 of the Lucas '037 Application) shows a right side, left side, front, back, and top view of a dipole audio speaker. As shown in FIGS. 2C-2D, the sound emits from the front and back of the dipole audio speaker.

It was discovered that such speakers can be made to have a "null sound plane" (or "NSP") where there is approximately no sound even when the speaker is playing at maximum volume. Just a few centimeters on either side of this plane the music/sound can be over 100 dB. This NSP is an ideal location for MEMS microphones because these microphones are able to sense human voices even when the speaker is playing very loud music (as if the room is silent except for the person's voice). When the MEMs microphones were placed at locations other than the NSP, these microphones had difficulty sensing human voices over the loud music. This problem is exasperated with the speakers disclosed and taught in the Pinkerton '715 Patent, the Pinkerton '073 Application, the Pinkerton '488 Application, and the Lucas '037 Application, as they generally are louder than conventional speakers (particularly at low frequencies).

Figure 3A:
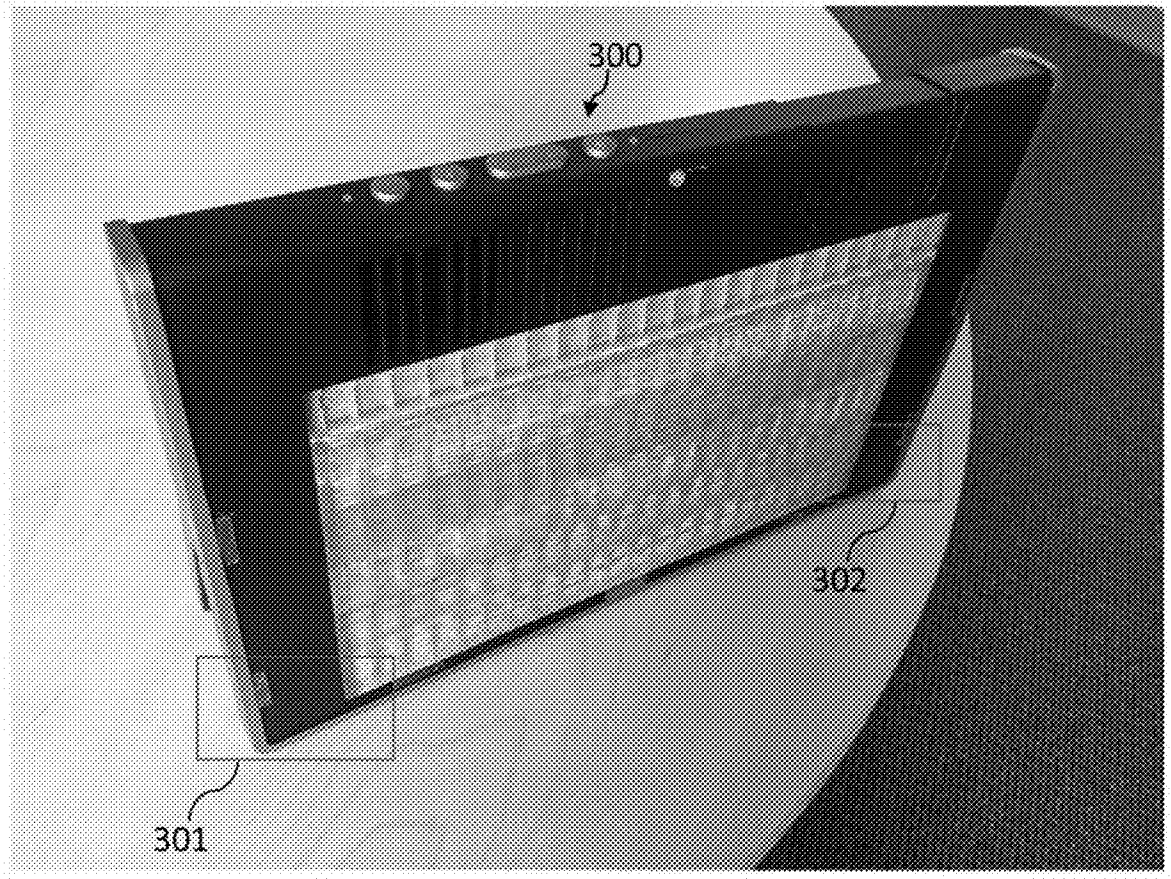
FIG. 3A is a photograph of a dipole speaker.
Figure 3B:
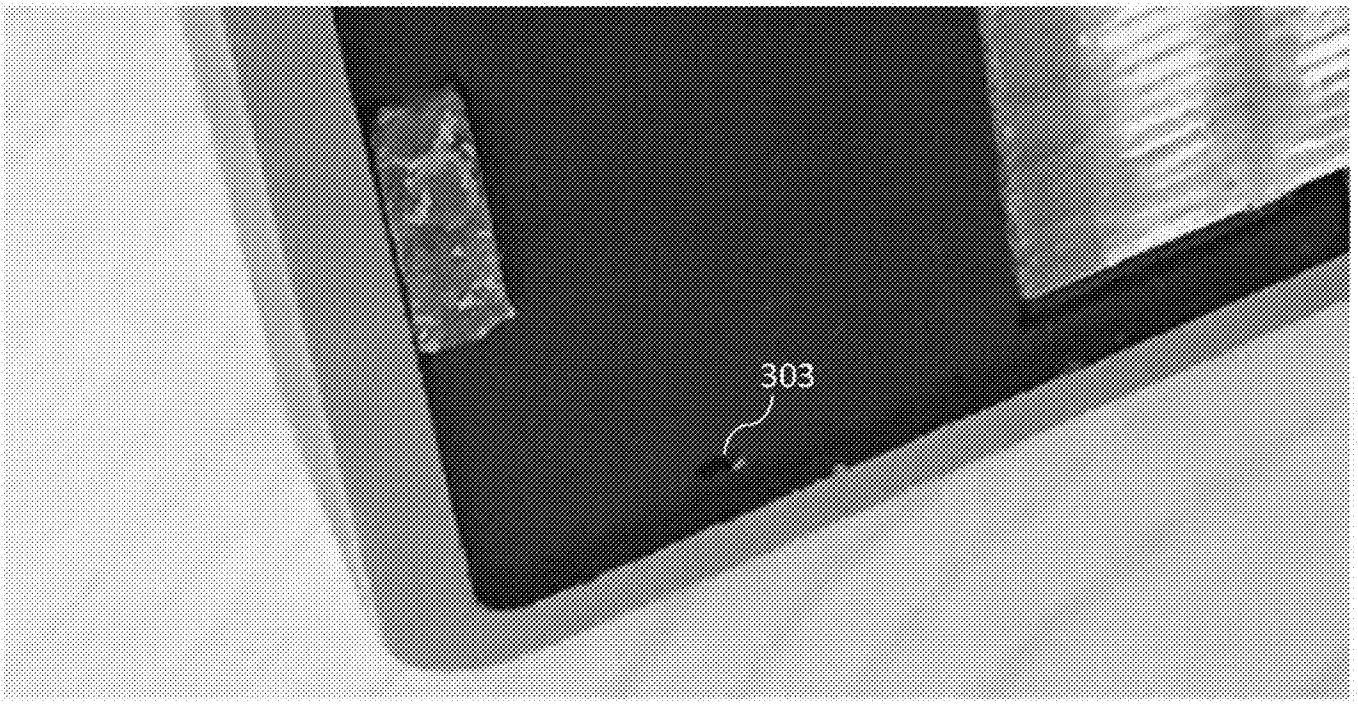
FIGS. 3B-3C are magnified portions of the dipole speaker shown in FIG. 3A.
Figure 3C:
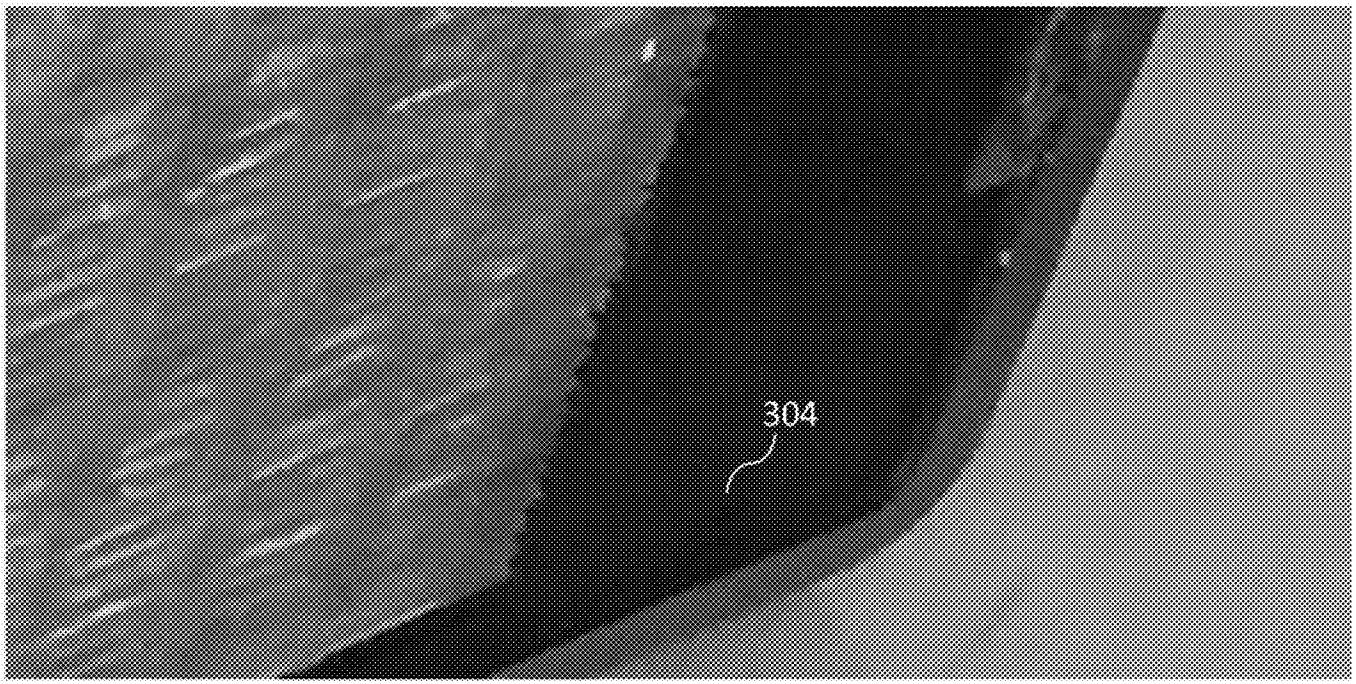

FIG. 3A is a photograph of a dipole speaker with its microphone ports 303-304 (shown in FIGS. 3B-3C, which are, respectively, magnified portions of boxes 301-302 in FIG. 3A) positioned outside of the null sound plane of the speaker. The microphones (MEMS microphones) are located behind the microphone ports 303-304 shown in FIGS. 3B-3C. These microphone locations were found to be suboptimal due to a high dB level near the microphones.

Figure 4:
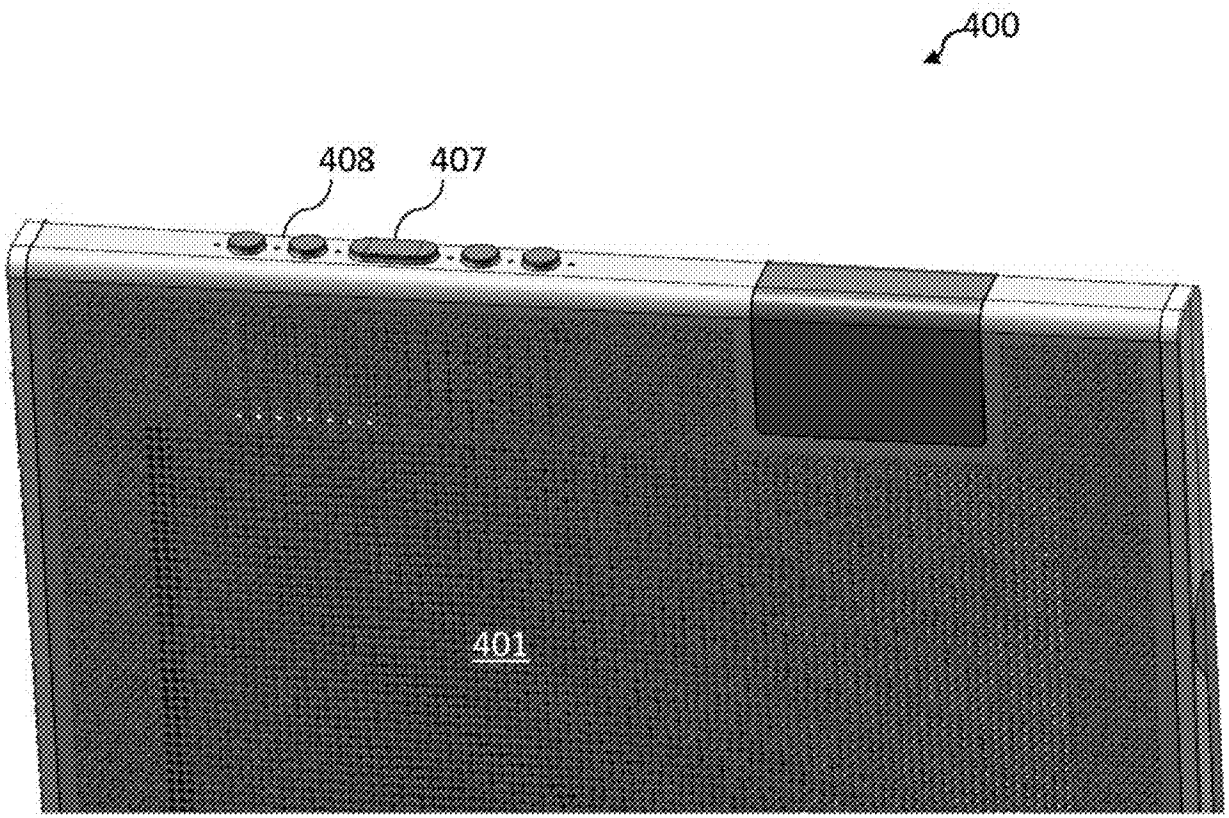
FIG. 4 is an illustration of an embodiment of the present invention.

FIG. 4 is an illustration of a dipole speaker 400 that has all electrostatic transducers. Sound comes out from side 401 and oppositely phased sound comes out the other side (not shown). It also has control buttons 407 and MEMs microphone ports 408 (with the MEMs microphones located behind microphone ports 408). The MEMs microphones are for example Knowles SPK0412HM4H-B-7 (Knowles Electronics, LLC, Itasca, Ill.) and are operably connected to a power source and a CPU on the speaker 400. The power source is generally the same power source as used for the speaker and the CPU controls the electrostatic transducers.

Figure 5A:
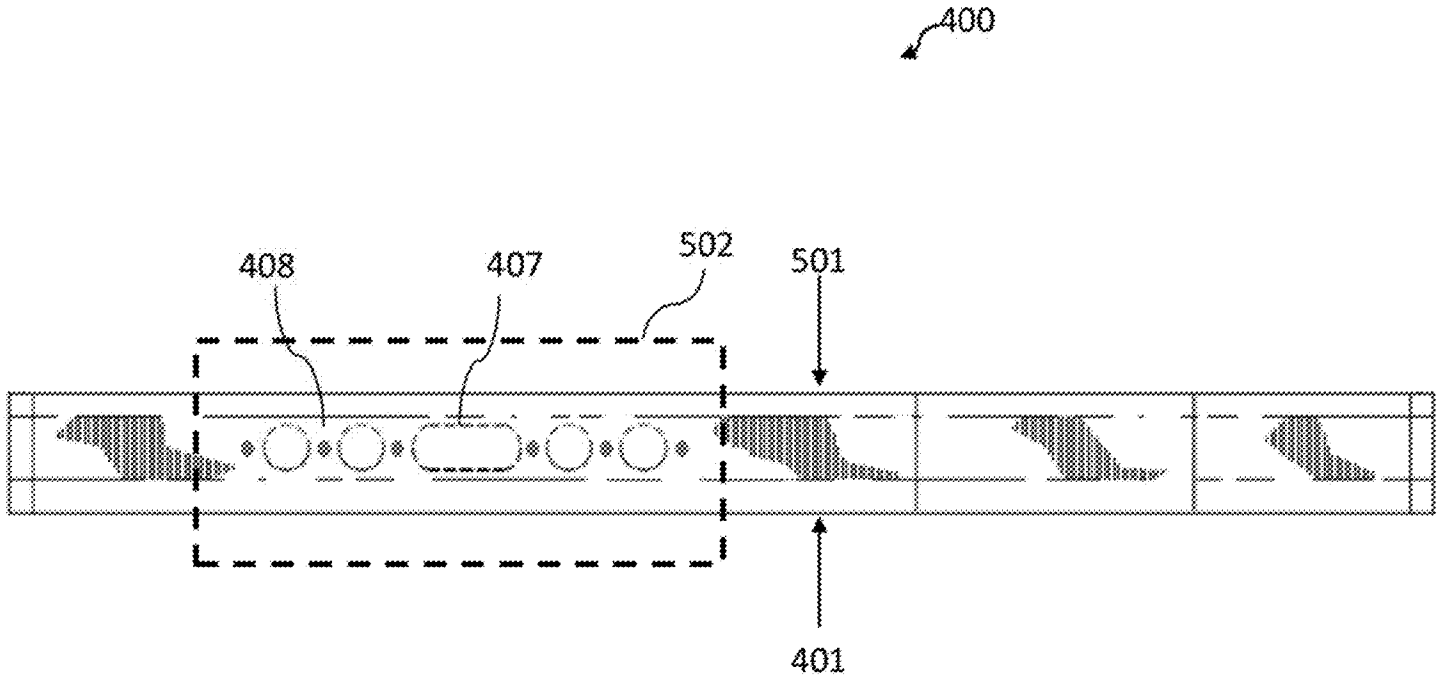
FIG. 5A is a top view of the speaker of FIG. 4 that shows only the top of the speaker.
Figure 5B:
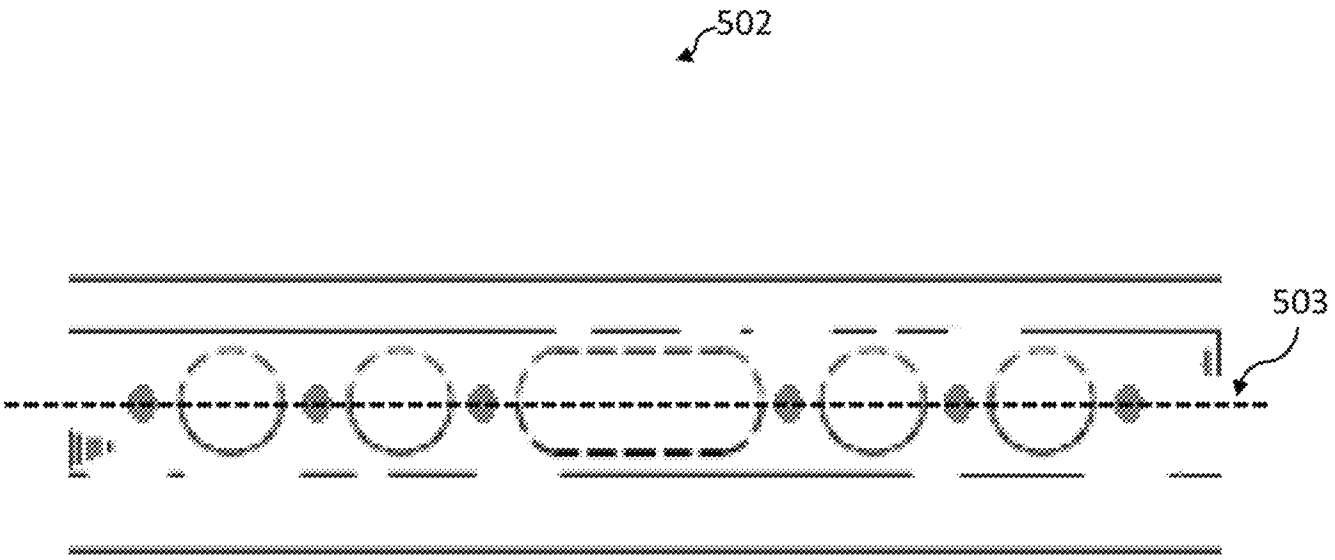
FIG. 5B is a magnified portion of the top of the speaker shown in FIG. 5A.

The MEMs microphone ports 408 on the speaker 400 have been positioned along the null sound plane (NSP) of the speaker 400 (which null sound plane 503 shown in FIG. 5B).

FIG. 5A is a top view of speaker 400, showing only the top. Opposite sides 401 and 501 are shown. Sound emits from side 401 and oppositely phased sound out side 501 in speaker 400 (which makes it a dipole speaker).

FIG. 5B is a magnified view of box 502 shown in FIG. 5A. The null sound plane 503 for speaker 400 is shown. The MEMs microphone ports are positioned along this null sound plane 503. The existence and the effects of this null sound plane 503 in the speaker 400 was a surprising discovery that occurred while testing a prototype of this dipole speaker.

A comparison was performed between embodiments of the present invention and prior art speakers that are voice controlled/activated. While playing loud music on speakers utilized in embodiments of the present invention (such as the speakers disclosed and taught in the Pinkerton '715 Patent, the Pinkerton '073 Application, the Pinkerton '488 Application, and the Lucas '037 Application) the sound meter read 100 dB 30 cm away from (and in front of) the speaker and 75 dB 1 cm above the top center (17.8 times less sound pressure). Playing the same music utilizing a conventional monopole speaker was about 100 dB 30 cm away (and in front of) the speaker and 105 dB 1 cm above its top center (3.2 times more sound pressure). The dB difference between these two speakers is about 57× in sound pressure (the approximate difference between a rock concert and a quiet room).

Due to symmetry in the design of the audio speaker, the null sound plane was located along the centerline of the speaker, when the speaker was in the closed position (i.e., the kickstand of the audio speaker was closed) and the speaker stood up vertically.

When the kickstand is used (such as shown in FIGS. 2A-2B), there is a slight shift of the null sound plane a few millimeters away from the kickstand side. This effect is small, i.e., just a few dB increase for microphone ports located in the centerline along the top of the speaker. It was found that this centerline is still the preferred location for the microphone ports because the kickstand may or may not be used for the audio speaker.

Accordingly, "substantially" along the null sound plane of the dipole speaker means that the microphones are placed along the null sound plane of the dipole speaker so that they receive no more than 20% of the maximum sound pressure being generated by the speaker during its normal operation and configuration, and, more preferably, no more than 10%.

A good analogy of the import of embodiments of the present invention is trying to carry on a conversation at a rock concert (the microphones of a conventional monopole speaker) and a quiet room (the microphones in the speaker of the present invention). It is much easier to understand what is being said in a quiet room; the voice recognition on the dipole speaker utilizing microphones located in the NSP used in embodiments of the present invention will be much more accurate than the voice recognition of a conventional speaker.

Figure 6:
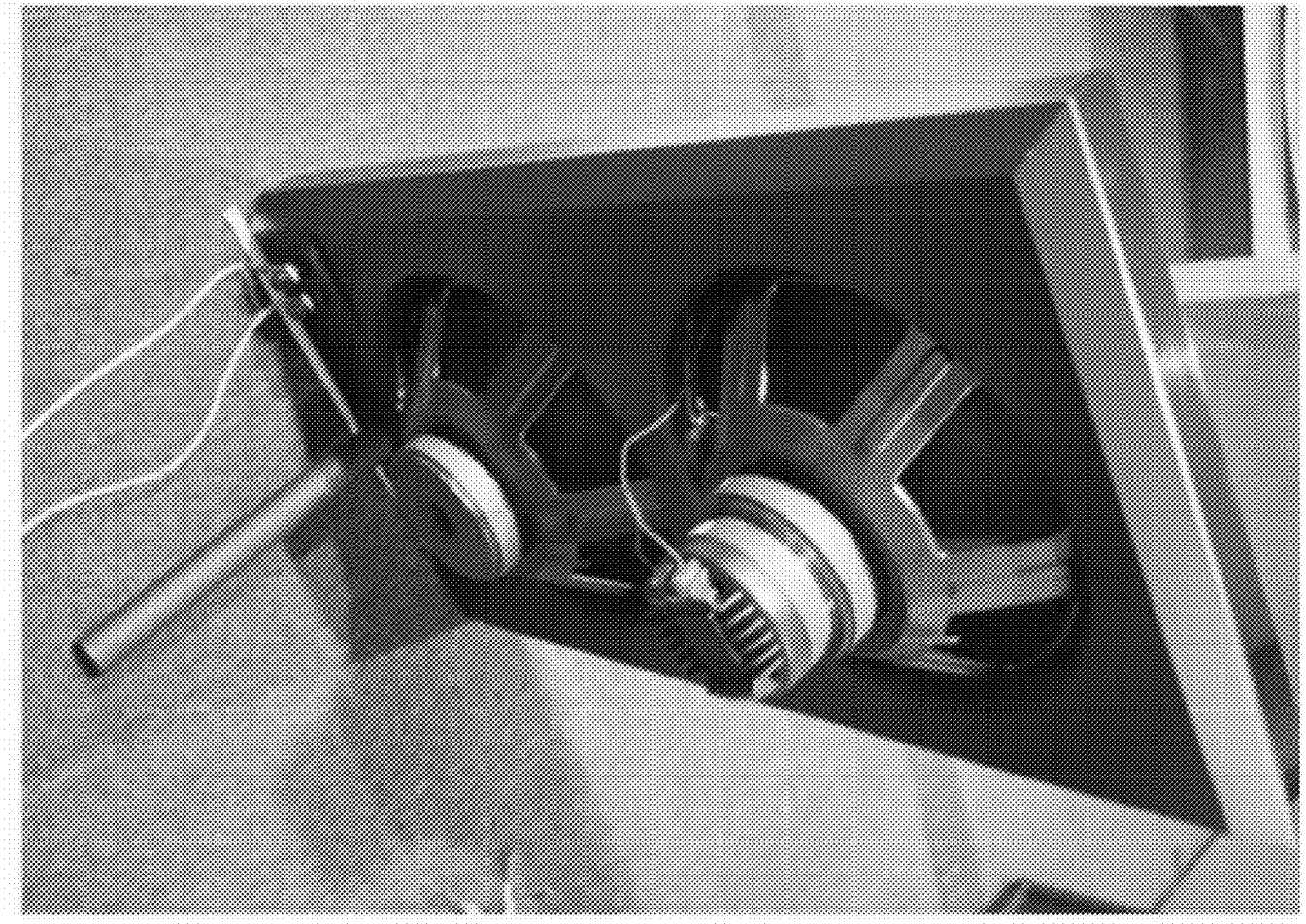
FIG. 6 is a photograph of the backside of a dipole speaker utilizing two electro-dynamic transducers.

Other types of dipole speakers, such as the electrodynamic dipole speaker shown in FIG. 6 can be utilized in embodiments of the present invention. Accordingly, other embodiments are within the scope of the following claims. The scope of protection is not limited by the description set out above, but is only limited by the claims which follow, that scope including all equivalents of the subject matter of the claims.

Stereophonic Sound

The Pinkerton '055 Application (including the devices set forth in the Badger '620 Application) describes and teaches loudspeaker system that produces an improved audio quality for stereophonic sound. The present invention is a modification of these devices in which the wider card drivers (21 mm) are replaced with conventional electro-dynamic drivers and (optionally) passive radiators located in a sealed chamber that cover the audio frequency range of 20 Hz to approximately 300 Hz. The narrower cards (12 mm) are placed outside the sealed chamber and cover the remaining 98% of the audio frequency spectrum (300 Hz to 20 kHz). Both the stacks and cones can operate in the 200-500 Hz range.

The device of the present invention can also include a new feature in the arrangement and angle of narrower card stacks (12 mm). This arrangement produces a wider soundstage, increases the angle that a listener perceives stereo separation and also improves near wall performance (since the sound waves directed toward a wall are reflected off the wall at an angle which further increases the speaker's soundstage and any front/back wave cancellation is minimized).

Figure 7:
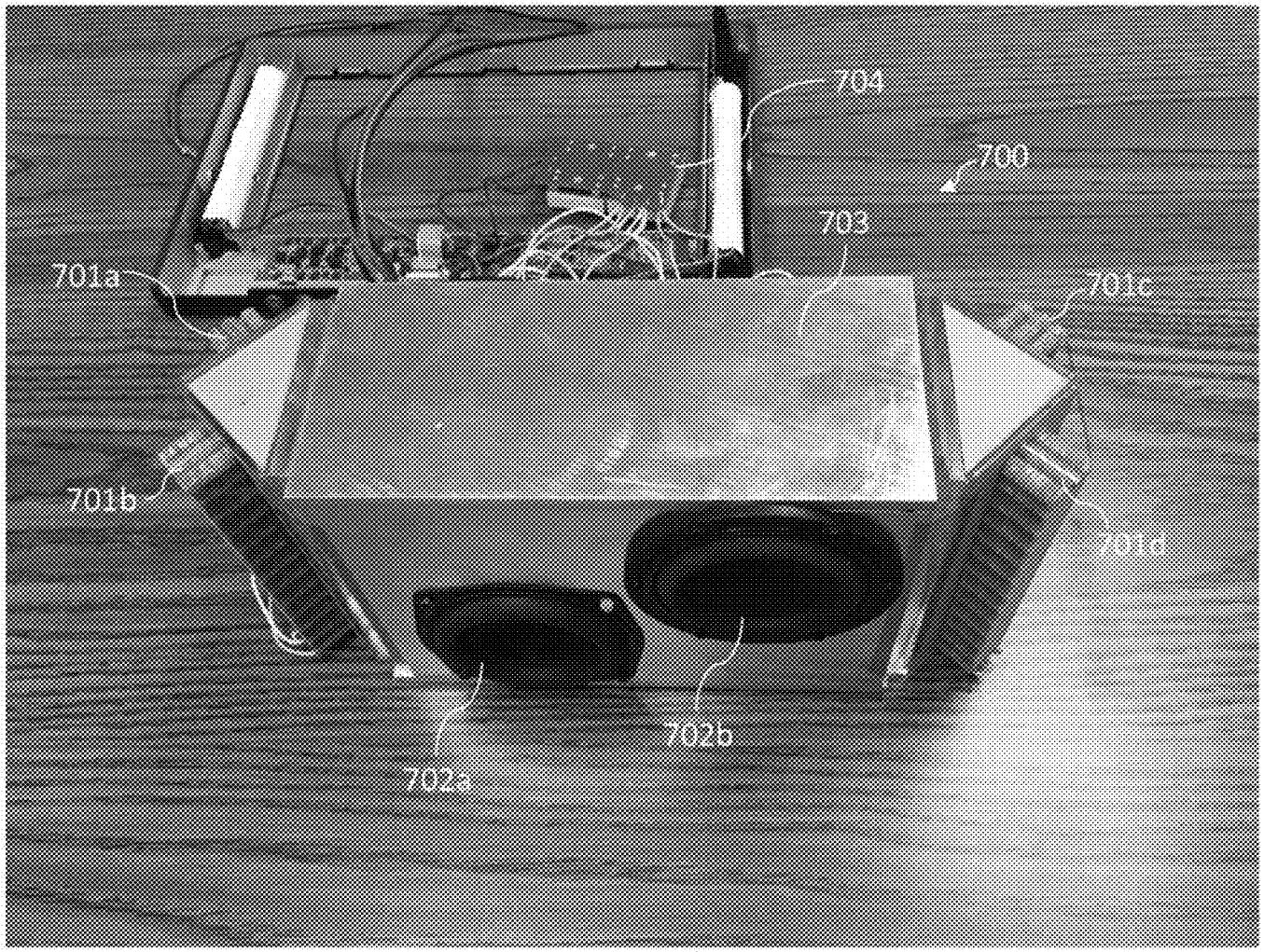
FIG. 7 is a photograph of the loudspeaker of the present invention showing the arrangement of the four card stacks in the arranged angles.
Figure 8A:
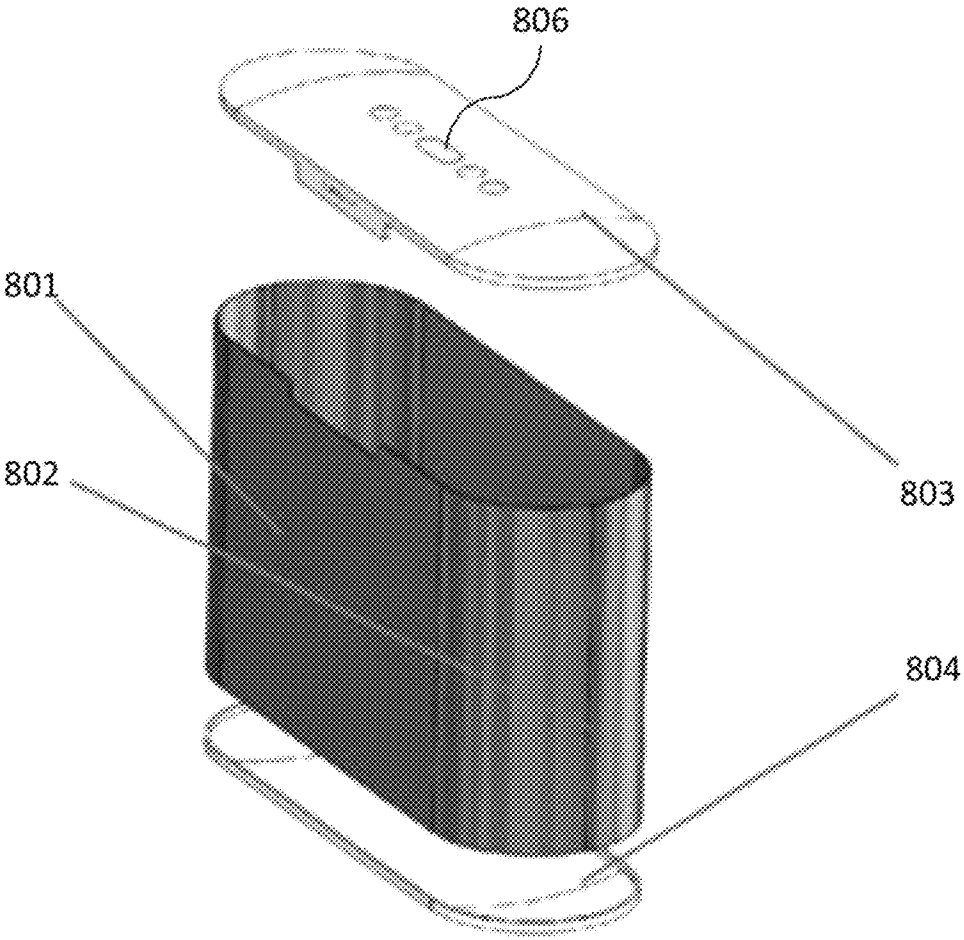
FIGS. 8A-8E are illustrations of the loudspeaker of the present invention, showing a perspective, exploded perspective, frontal, right side, and top view, respectively.
Figure 8B:
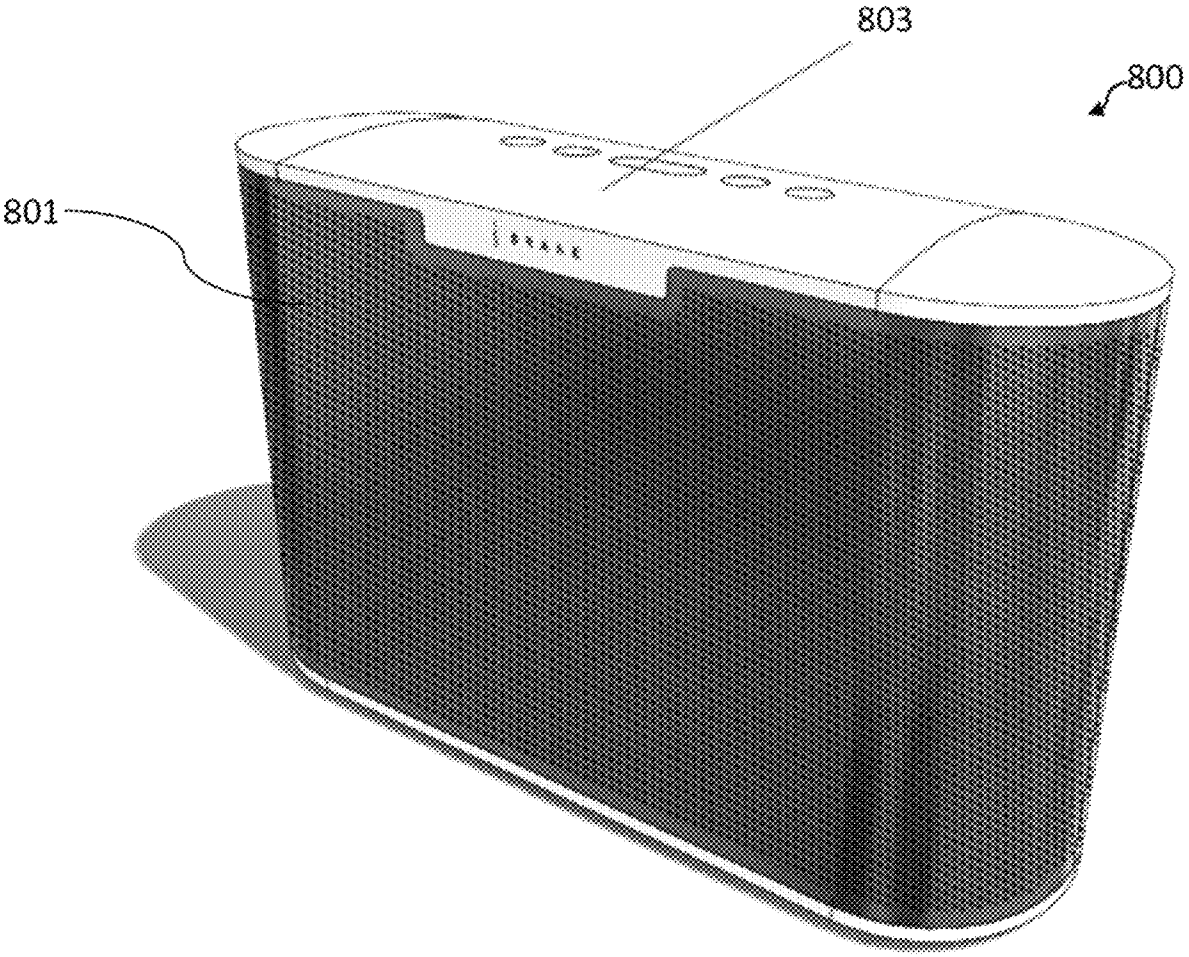
Figure 8C:
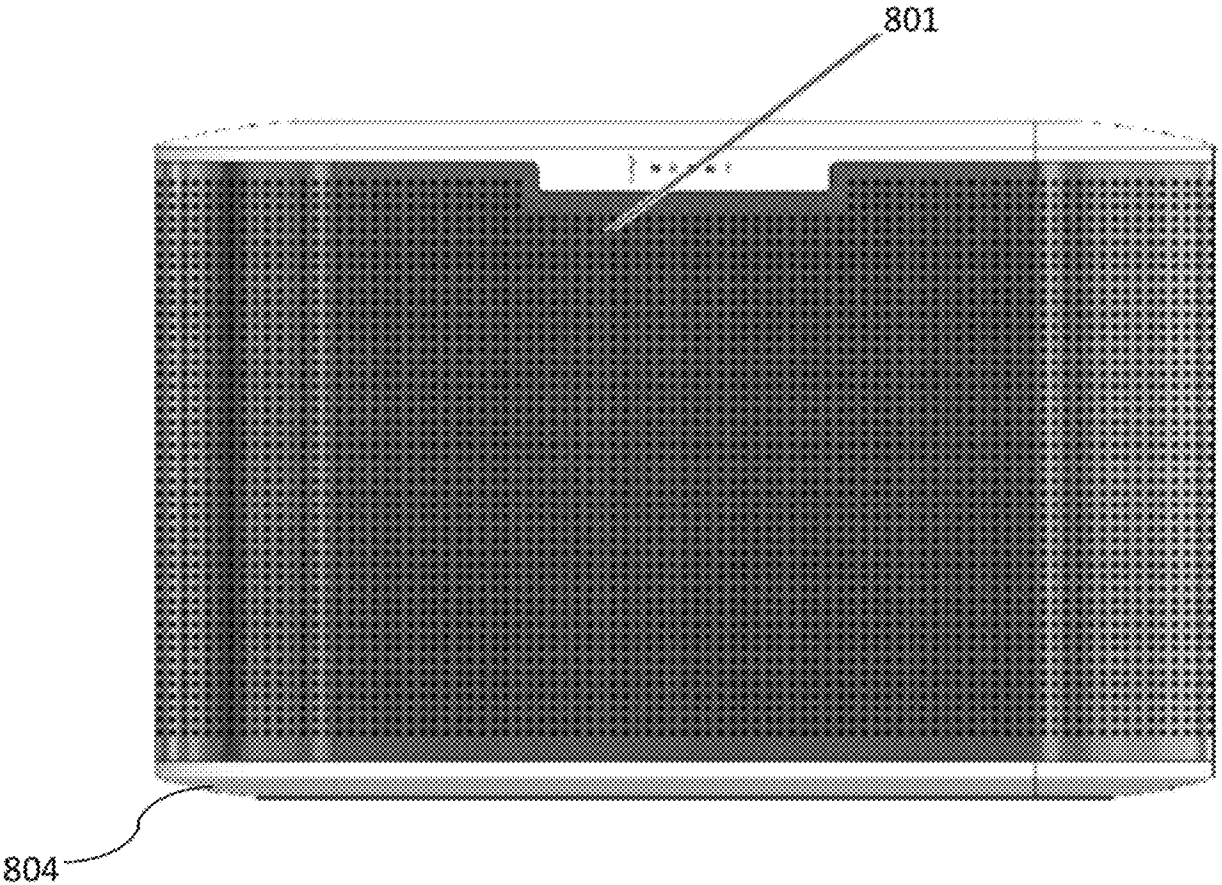
Figure 8D:
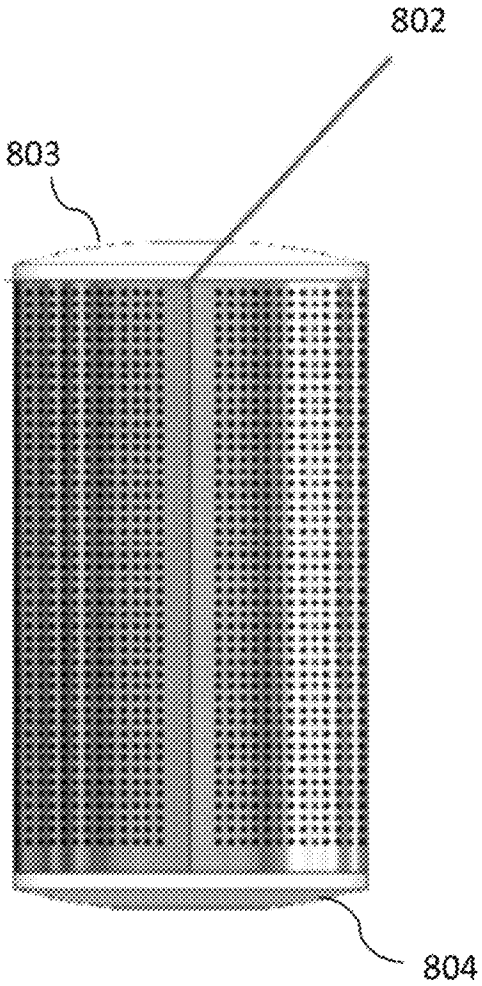
Figure 8E:
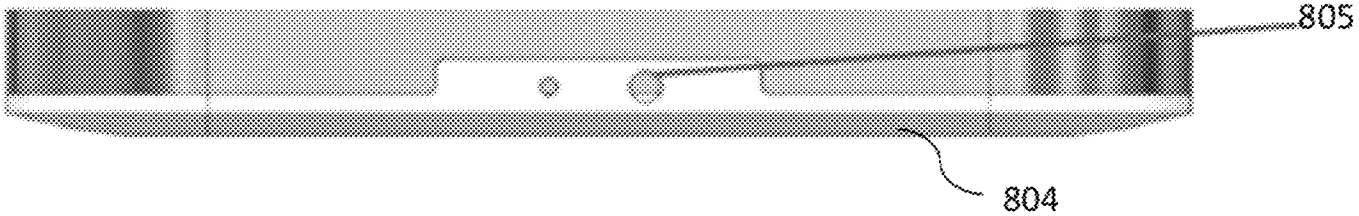

FIG. 7 is a photograph of loudspeaker 700 showing the arrangement of the four card stacks 701*a*-701*d* (of electrostatic membrane pumps) in the arranged angles. As shown in FIG. 7, the arrangement of the four card stacks 701*a*-701*d* is around 90 degrees. The arranged angles can be generally at least around 30 degrees, and more generally around 45 degrees to around 120 degrees, and even more generally around 60 degrees to around 90 degrees. Loudspeaker 700 has a sealed chamber 703 that houses conventional electro-dynamic drivers 702*a*-702*b* and (optionally) passive radiators. Controller 704 is also electrically connected to the speakers to operate the card stacks 701*a*-701*d* and electro-dynamic drivers 702*a*-702*b* to produce the sound at the desired audio frequencies.

Figure 9A:
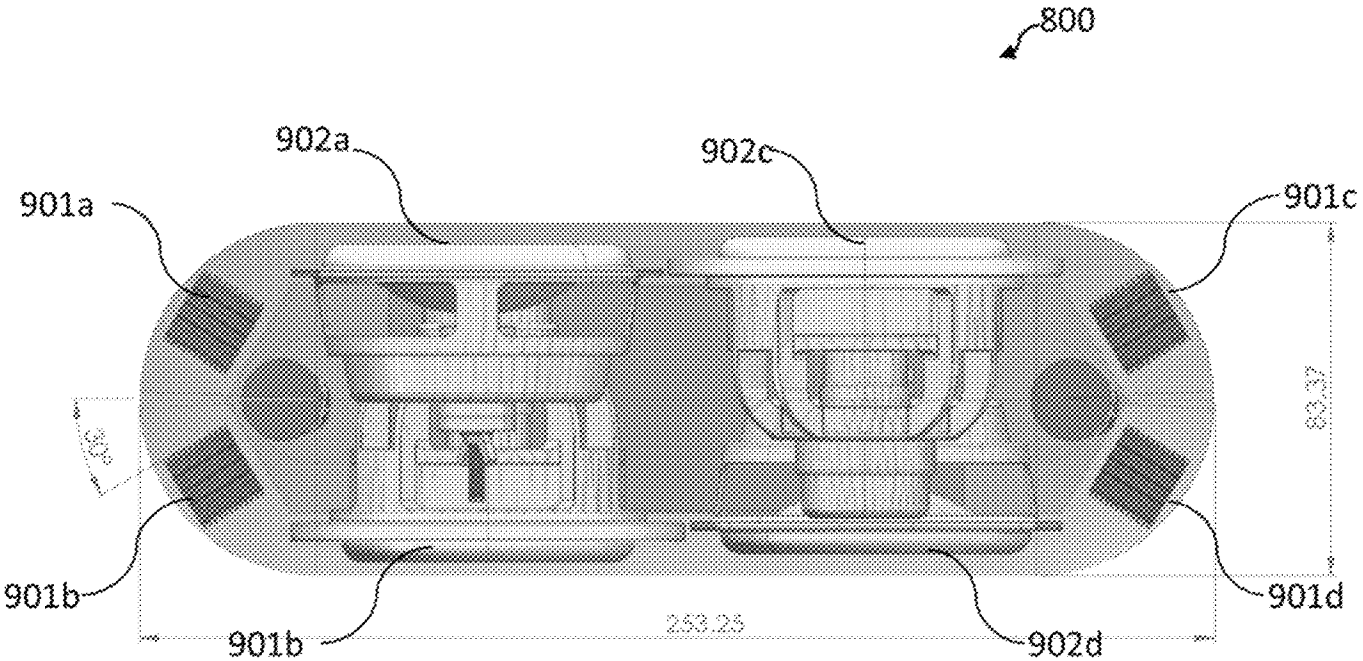
FIGS. 9A-9C are illustrations of the loudspeaker of the present invention, showing a top, frontal, and side view, respectively, with transparent walls of the loudspeaker.
Figure 9B:
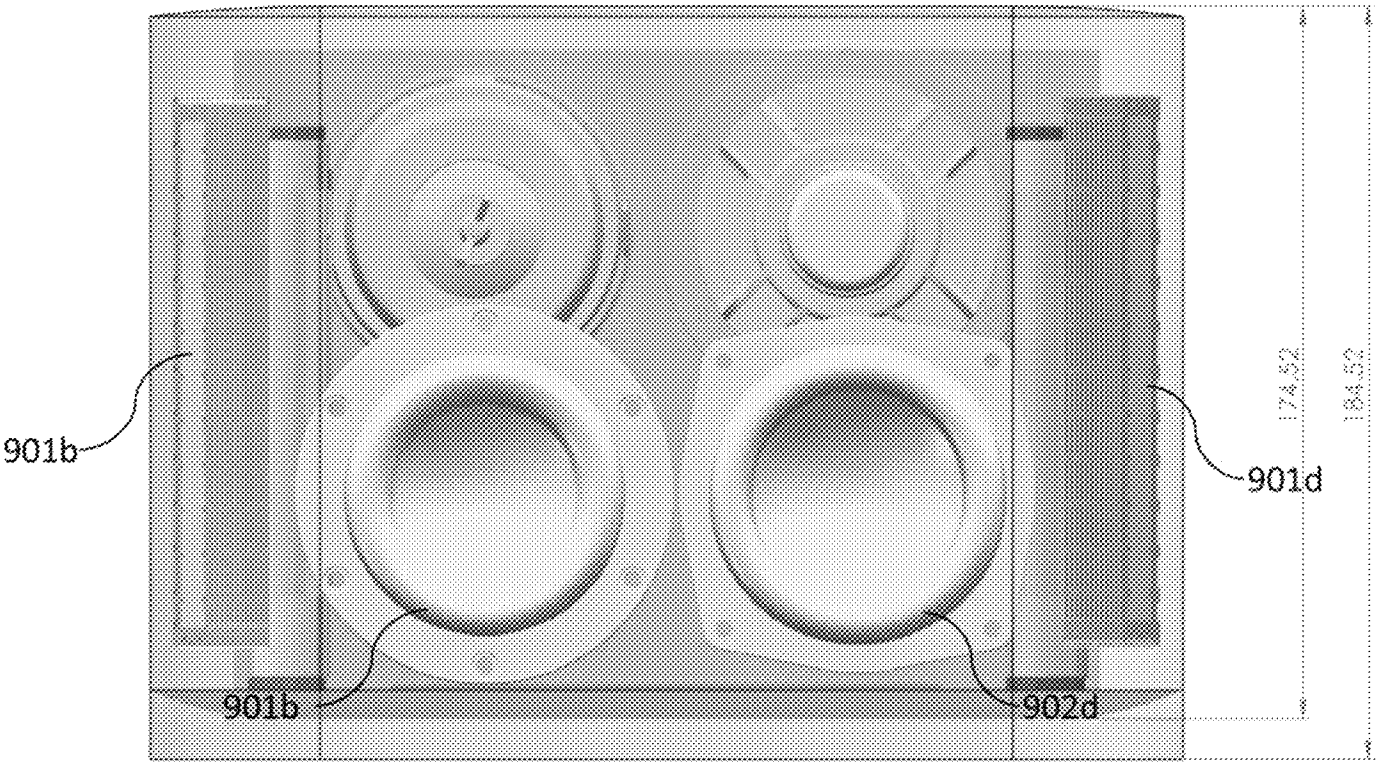
Figure 9C:
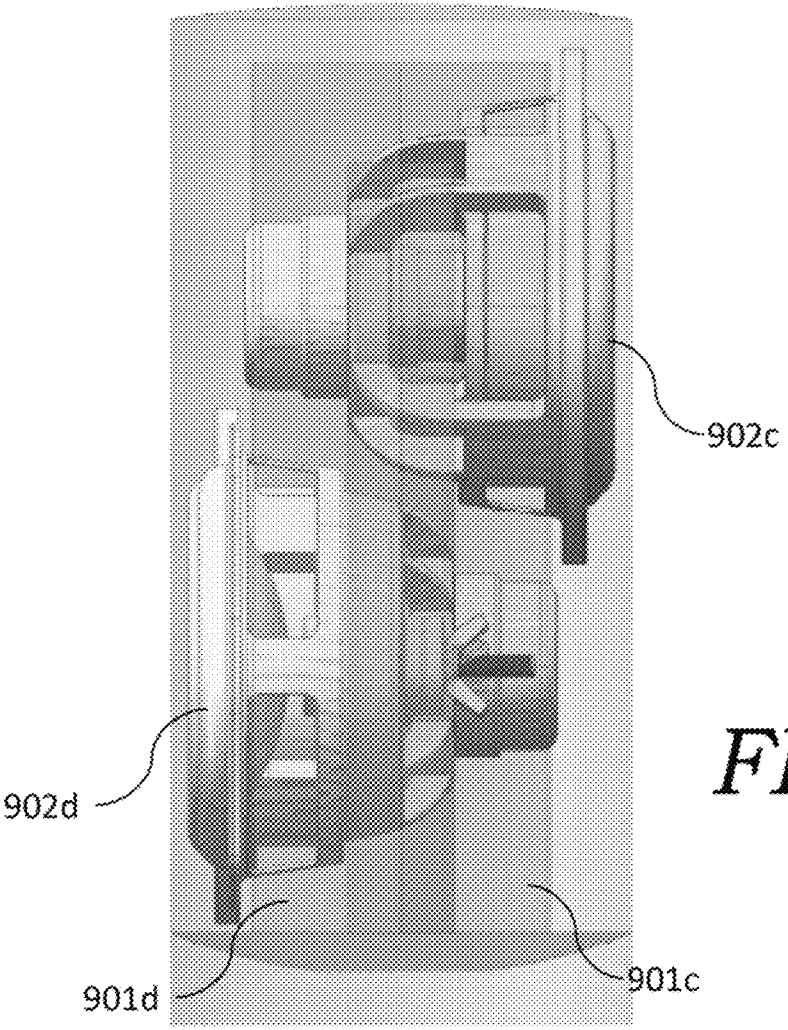

FIGS. 8A-8E are illustrations of loudspeaker 800, showing a perspective, exploded perspective, frontal, right side, and top view, respectively. Certain interior elements of loudspeaker 800 are depicted in FIGS. 9A-9C. Loudspeaker 800 has a top 803 (with control buttons 806), a bottom 804, and a perforated sheet 801 (such as made of aluminum) surrounding the body of loudspeaker, including about the card stacks 901*a*-901*d* and electro-dynamic drivers 902*a*-902*d*. As shown in FIGS. 9A-9C, the arrangement of the four card stacks 901*a*-901*d* is around 60 degrees. As shown in FIGS. 8A-8E, the top 801 is curved, which the bottom 804 is flat (and optionally can have feet for better support). The perforated sheet has a weld seam or clip 802. Loudspeaker 800 also has conventional electro-dynamic drivers 902*a*-902*d* and (optionally) passive radiators. Loudspeaker 800 also an I/O 805 through which a device can be connected for exchanging data to be used to generate the audio signals of the device. Alternatively, a device, such as a mobile device, can be wirelessly coupled to loudspeaker 800, such as through Bluetooth standard.

As shown in FIGS. 7, 8A-8E, and 9A-9C, it can be seen that, if a listener is 30-45 degrees to the right or left of the speaker, the listener has a left/right stack pair pointed approximately directly at them. The device shown in the figures was tested with the angle between the stacks at 90 degrees (like in FIG. 7) and another with 60 degrees between the stacks (like in FIGS. 9A-9C). Both angles result in high fidelity sound and produce a wide soundstage.

It was found that there is no "dead zone" with the low frequency unipolar drivers and the angled stacks minimize front/side sound variations in the higher part of the frequency spectrum. Also, the loudspeaker of the present invention produces the same sound out the back as it does out the front.

The "null sound plane" for the microphones of the present invention is maintained for 98% of the frequency spectrum (the most important part since lower frequency sounds can be filtered out).

Normally (for small speakers) one or more relatively large electro-dynamic drivers cover 20 Hz to 2-5 kHz and another set of smaller electro-dynamic drivers covers above 2-5 Hz. This means that the larger driver cannot be optimized for just the low frequencies (whereas the electro-dynamic drivers of the present loudspeakers can focus on low frequency sound production). The fact that the narrow (12 mm) card stacks can cover 300 Hz to 20 kHz allows the loudspeakers of the present invention to use electro-dynamic drivers (and in some cases also passive radiators) that perform very well in the 20-300 Hz range (much better than if these drivers also had to cover 2-5 kHz).

The end result of these modifications to the loudspeaker devices set forth in the Pinkerton '055 Application (including the devices set forth in the Badger '620 Application) is a speaker that is able to achieve high fidelity sound (including near a wall) and has a low manufacturing cost.

While embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. Other types of dipole speakers, such as the electro-dynamic dipole speaker shown in FIG. 6 can be utilized in embodiments of the present invention. Accordingly, other embodiments are within the scope of the following claims. The scope of protection is not limited by the description set out above, but is only limited by the claims which follow, that scope including all equivalents of the subject matter of the claims.

The disclosures of all patents, patent applications, and publications cited herein are hereby incorporated herein by reference in their entirety, to the extent that they provide exemplary, procedural, or other details supplementary to those set forth herein.

Amounts and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of approximately 1 to approximately 4.5 should be interpreted to include not only the explicitly recited limits of 1 to approximately 4.5, but also to include individual numerals such as 2, 3, 4, and sub-ranges such as 1 to 3, 2 to 4, etc. The same principle applies to ranges reciting only one numerical value, such as "less than approximately 4.5," which should be interpreted to include all of the above-recited values and ranges. Further, such an interpretation should apply regardless of the breadth of the range or the characteristic being described.

Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are now described.

Following long-standing patent law convention, the terms "a" and "an" mean "one or more" when used in this application, including the claims.

Unless otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in this specification and attached claims are approximations that can vary depending upon the desired properties sought to be obtained by the presently disclosed subject matter.

As used herein, the term "about" and "substantially" when referring to a value or to an amount of mass, weight, time, volume, concentration or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

As used herein, the term "substantially perpendicular" and "substantially parallel" is meant to encompass variations of in some embodiments within ±10° of the perpendicular and parallel directions, respectively, in some embodiments within ±5° of the perpendicular and parallel directions, respectively, in some embodiments within ±1° of the perpendicular and parallel directions, respectively, and in some embodiments within ±0.5° of the perpendicular and parallel directions, respectively.

As used herein, the term "and/or" when used in the context of a listing of entities, refers to the entities being present singly or in combination. Thus, for example, the phrase "A, B, C, and/or D" includes A, B, C, and D individually, but also includes any and all combinations and subcombinations of A, B, C, and D.

What is claimed is:

1. A loudspeaker having a middle section, a first end section located on a first side of the middle section, and a second end section located on the opposing side of the middle section, wherein the loudspeaker comprises:

(a) one or more electro-dynamic drivers in a sealed chamber, wherein the sealed chamber is in the middle section of the loudspeaker;

(b) a first electrostatic card stack driver and a second electrostatic card stack driver that are arranged in the loudspeaker at the first end section having an arranged angle between them of at least 30 degrees, wherein (i) the first electrostatic card stack driver operates at a first phase, and (ii) the second electrostatic card stack driver operates at the first phase; and (c) a third electrostatic card stack driver and a fourth electrostatic card stack driver that are arranged in the loudspeaker at the second end section having an arranged angle between them of at least 30 degrees, wherein (ii) the third electrostatic card stack driver operates at the first phase, (ii) the fourth electrostatic card stack driver operates at the first phase;

(d) the loudspeaker has a null sound plane for the first electrostatic card stack driver, the second electrostatic card stack driver, the third electrostatic card stack driver, and the fourth electrostatic card stack driver running from the first end section and the second end section; and (e) at least one microphone located substantially along the null sound plane.

2. The loudspeaker of claim 1, wherein:

(a) the one or more electro-dynamic drivers are operable to produce sound having an audio frequency in the range of 20 Hz to 300 Hz; and (b) each of the first electrostatic card stack driver, the second electrostatic card stack driver, the third electrostatic card stack driver, and the fourth electrostatic card stack driver are operable to produce sound having an audio frequency in the range of 300 Hz to 20 kHz.

3. The loudspeaker of claim 2, wherein each of the one or more electro-dynamic drivers and the first electrostatic card stack driver, the second electrostatic card stack driver, the third electrostatic card stack driver, and the fourth electrostatic card stack driver are operable to produce sound having an audio frequency in the range of 200 Hz to 500 Hz.

4. The loudspeaker of claim 2, wherein each of the first electrostatic card stack driver, the second electrostatic card stack driver, the third electrostatic card stack driver, and the fourth electrostatic card stack driver comprise card stacks having a width of around 12 mm.

5. The loudspeaker of claim 2, wherein (a) the first electrostatic card stack driver and the second electrostatic card stack driver have an arranged angle between them that is in the range of 45 degrees and 120 degrees; and (b) the third electrostatic card stack driver and the fourth electrostatic card stack driver have an arranged angle between them that is in the range of 45 degrees and 120 degrees.

6. The loudspeaker of claim 2, wherein (a) the first electrostatic card stack driver and the second electrostatic card stack driver have an arranged angle between them that is in the range of 60 degrees and 90 degrees; and (b) the third electrostatic card stack driver and the fourth electrostatic card stack driver have an arranged angle between them that is in the range of 60 degrees and 90 degrees.

7. The loudspeaker of claim 2 further comprising a controller operable for controlling each of the one or more electro-dynamic drivers and the first electrostatic card stack driver, the second electrostatic card stack driver, the third electrostatic card stack driver, and the fourth electrostatic card stack driver.

8. The loudspeaker of claim 2, wherein at least one of the one or more electro-dynamic drivers has a passive radiator.

9. A method comprising the steps of:

(a) selecting a loudspeaker comprising (i) one or more electro-dynamic drivers in a sealed chamber, (ii) a plurality of electrostatic card stack drivers, wherein (A) the loudspeaker has a middle section, a first end section located on a first side of the middle section, and a second end section located on the opposing side of the middle section;

(B) the sealed chamber is in the middle section of the loudspeaker;

(C) the plurality of electrostatic card stack drivers comprises a first electrostatic card stack driver, a second electrostatic card stack driver, a third electrostatic card stack driver, and a fourth electrostatic card stack driver;

(D) the first electrostatic card stack driver and the second electrostatic card stack driver are arranged in the loudspeaker at the first end section having an arranged angle between them of at least 30 degrees; and (E) the third electrostatic card stack driver and the fourth electrostatic card stack driver are arranged in the loudspeaker at the second end section having an arranged angle between them of at least 30 degrees, (iii) the loudspeaker has a null sound plane for the first electrostatic card stack driver, the second electrostatic card stack driver, the third electrostatic card stack driver, and the fourth electrostatic card stack driver running from the first end section and the second end section, and (iv) at least one microphone located substantially along the null sound plane;

(b) utilizing the one or more electro-dynamic drivers to produce sound having an audio frequency in the range of 20 Hz to 300 Hz;

(c) utilizing the plurality of the electrostatic card stack drivers to produce sound having an audio frequency in the range of 300 Hz to 20 kHz, wherein the first electrostatic card stack driver, the second electrostatic card stack driver, the third electrostatic card stack driver, and the fourth electrostatic card stack driver produce the sound in a same first phase; and (d) utilizing the at least one microphone that is located substantially along the null sound plane.

10. The method of claim 9 further comprising the step of utilizing each of the one or more electro-dynamic drivers and the first electrostatic card stack driver, the second electrostatic card stack driver, the third electrostatic card stack driver, and the fourth electrostatic card stack driver to produce sound having an audio frequency in the range of 200 Hz to 500 Hz.

11. The method of claim 9, wherein each of the first electrostatic card stack driver, the second electrostatic card stack driver, the third electrostatic card stack driver, and the fourth electrostatic card stack driver comprise card stacks having a width of around 12 mm.

12. The method of claim 9, wherein (a) the first electrostatic card stack driver and the second electrostatic card stack driver have an arranged angle between them that is in the range of 45 degrees and 120 degrees; and (b) the third electrostatic card stack driver and the fourth electrostatic card stack driver have an arranged angle between them that is in the range of 45 degrees and 120 degrees.

13. The method of claim 9, wherein (a) the first electrostatic card stack driver and the second electrostatic card stack driver have an arranged angle between them that is in the range of 60 degrees and 90 degrees; and (b) the third electrostatic card stack driver and the fourth electrostatic card stack driver have an arranged angle between them that is in the range of 60 degrees and 90 degrees.

14. The method of claim 9 further comprising the step of utilizing a controller to control each of the one or more electro-dynamic drivers and the first electrostatic card stack driver, the second electrostatic card stack driver, the third electrostatic card stack driver, and the fourth electrostatic card stack driver.

15. The method of claim 9, wherein at least one of the one or more electro-dynamic drivers has a passive radiator.

* * * * *